US007775171B2

(12) United States Patent
Tupil

(10) Patent No.: US 7,775,171 B2
(45) Date of Patent: Aug. 17, 2010

(54) FLEXIBLE FLUID CONTAINMENT VESSEL FEATURING A KEEL-LIKE SEAM

(75) Inventor: Srinath Tupil, Chelmsford, MA (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 10/347,996

(22) Filed: Jan. 21, 2003

(65) Prior Publication Data

US 2004/0139898 A1 Jul. 22, 2004

(51) Int. Cl.
*B63B 25/00* (2006.01)
*B63B 25/08* (2006.01)
*B63B 25/12* (2006.01)
*B65D 88/00* (2006.01)

(52) U.S. Cl. ..... 114/74 R; 114/74 T; 114/256

(58) Field of Classification Search ..... 114/74 R, 114/74 T, 74 A, 256; 220/560, 9.4, 9.1, 9.2, 220/9.3, 677–684; 405/15, 32; 138/118.1, 138/119, 123; 383/107, 108, 117
See application file for complete search history.

(56) References Cited

U.S. PATENT DOCUMENTS

| | | | | |
|---|---|---|---|---|
| 34,426 | A | 2/1862 | Howard | |
| 130,303 | A * | 8/1872 | Libby | 138/123 |
| 143,661 | A * | 10/1873 | Blake | 138/128 |
| 154,725 | A * | 9/1874 | Street | 138/128 |
| 389,615 | A | 9/1888 | Townsend | |
| 1,447,981 | A * | 3/1923 | Henderson | 383/25 |
| 1,702,593 | A * | 2/1929 | Pierce | 383/107 |
| 1,723,307 | A | 8/1929 | Sipe | |
| 1,921,015 | A | 8/1933 | Young | |
| 2,065,480 | A | 12/1936 | Soper | |
| 2,115,368 | A * | 4/1938 | Lustberg | 428/57 |
| 2,350,158 | A * | 5/1944 | Evans | 138/123 |
| 2,371,404 | A | 3/1945 | Mumford | |
| 2,372,632 | A * | 3/1945 | Webb | 428/104 |
| 2,391,926 | A | 1/1946 | Scott | |
| 2,406,830 | A * | 9/1946 | Haman et al. | 428/104 |
| 2,492,699 | A | 12/1949 | Houwink | |

(Continued)

FOREIGN PATENT DOCUMENTS

DE 2413383 A * 10/1975 ..... 114/256

(Continued)

OTHER PUBLICATIONS

*McGraw-Hill Encyclopedia of Science and Technology, 6th Edition*, 1987, McGraw-Hill Book Company, New York XP00220369918, pp. 247-248 Paragraph 4; figures 6-8.

(Continued)

*Primary Examiner*—Ajay Vasudeva
(74) *Attorney, Agent, or Firm*—Frommer Lawrence & Haug LLP; Ronald R. Santucci

(57) ABSTRACT

A flexible fluid containment vessel (FFCV) including at least one segment made up of a fabric. Two ends of the fabric are beaded and are joined together so as to form a generally cylindrical section. The interface along which the ends of the fabric are joined form a keel that serves to stabilize the completed FFCV when the FFCV is placed in water.

20 Claims, 6 Drawing Sheets

U.S. PATENT DOCUMENTS 2,595,408 A * 5/1952 Quest ..... 405/40
2,674,287 A * 4/1954 Smith et al. ..... 220/666
2,685,964 A 8/1954 Brown
2,704,677 A * 3/1955 Quest ..... 285/5
2,724,358 A 11/1955 Harris et al.
2,725,027 A 11/1955 Brandon et al.
2,794,192 A 6/1957 Paris
2,854,049 A 9/1958 Wyllie
2,939,501 A * 6/1960 Corman et al. ..... 383/107
2,968,272 A 1/1961 Berglund
2,979,008 A 4/1961 Whipple
2,997,973 A * 8/1961 Hawthorne et al. ..... 114/74 T
2,998,793 A 9/1961 Hawthorne et al.
3,001,501 A 9/1961 Hawthorne et al.
3,018,748 A 1/1962 Denis et al.
3,050,750 A * 8/1962 Harrison ..... 441/136
3,056,373 A 10/1962 Hawthorne et al.
3,067,712 A 12/1962 Doerpinghaus
3,150,627 A 9/1964 Stewart et al.
3,167,103 A * 1/1965 Hawthorne et al. ..... 114/74 R
3,224,403 A 12/1965 Paddington
3,246,621 A * 4/1966 Copeland ..... 112/413
3,282,361 A 11/1966 Mackie
3,289,721 A 12/1966 Benson
3,296,994 A 1/1967 Schirtzinger
3,502,046 A 3/1970 Stauber
3,506,516 A * 4/1970 Baumann ..... 156/226
3,561,219 A 2/1971 Nishizawa
3,622,437 A 11/1971 Hobaica et al.
3,661,693 A 5/1972 Pierson
3,672,319 A 6/1972 Platzer
3,686,064 A * 8/1972 Bonnet et al. ..... 442/221
3,721,603 A * 3/1973 Takeda ..... 428/36.1
3,739,410 A 6/1973 Fortin
3,762,108 A 10/1973 Pierson
3,774,563 A 11/1973 Anderson, Sr. et al.
3,779,196 A * 12/1973 Knaus et al. ..... 114/74 T
3,792,589 A * 2/1974 Sayles ..... 405/68
3,797,445 A 3/1974 Zeimer
3,812,805 A 5/1974 Forssell et al.
3,839,869 A 10/1974 Green
3,839,977 A 10/1974 Bradberry
3,922,861 A * 12/1975 Grihangne ..... 405/64
3,952,679 A 4/1976 Grihangne
3,955,524 A 5/1976 Renoux
3,974,789 A 8/1976 DeGroot
3,998,304 A * 12/1976 Edgerton et al. ..... 190/107
4,108,101 A 8/1978 Schirtzinger
4,190,010 A * 2/1980 Bibby ..... 112/419
4,227,474 A 10/1980 Ullrich
4,227,477 A 10/1980 Preus
4,227,478 A 10/1980 Preus
4,230,061 A 10/1980 Roberts
4,373,462 A 2/1983 Fish
4,399,765 A 8/1983 Alkner et al.
4,446,181 A * 5/1984 Wood ..... 428/36.1
4,468,812 A * 8/1984 Grosvenor ..... 383/108
4,478,661 A * 10/1984 Lewis ..... 156/92
4,506,623 A 3/1985 Roper et al.
4,508,582 A * 4/1985 Fink ..... 156/93
4,509,558 A 4/1985 Slater
4,510,201 A 4/1985 Takeuchi et al.
4,530,868 A * 7/1985 Shinmi et al. ..... 428/57
4,582,756 A 4/1986 Niinuma et al.
4,662,386 A 5/1987 Pedersen
4,668,545 A 5/1987 Lowe
4,726,986 A 2/1988 Cannady, Jr. et al.
4,910,817 A 3/1990 Kita
4,933,231 A 6/1990 Seber
4,998,498 A 3/1991 Gallichan
5,082,726 A 1/1992 Bastiaens et al.
5,087,071 A * 2/1992 Wallner et al. ..... 280/743.1
5,194,459 A 3/1993 Sato et al.
5,203,272 A 4/1993 Kassinger et al.
5,235,928 A 8/1993 Shank, Jr.
5,243,925 A 9/1993 Fortenberry
5,262,230 A 11/1993 Becker et al.
5,355,819 A 10/1994 Hsia et al.
5,360,656 A 11/1994 Rexfelt et al.
5,391,424 A 2/1995 Kolzer
5,413,065 A 5/1995 Spragg et al.
5,421,128 A 6/1995 Sharpless et al.
5,431,970 A 7/1995 Broun et al.
5,482,763 A 1/1996 Shaffer
5,488,921 A 2/1996 Spragg
5,503,291 A 4/1996 Craig
5,505,557 A * 4/1996 Bradley ..... 405/15
5,544,612 A 8/1996 Eymard
5,580,185 A * 12/1996 Ware ..... 405/72
5,657,714 A 8/1997 Hsia et al.
5,691,390 A 11/1997 Harrison et al.
5,713,399 A 2/1998 Collette et al.
5,735,083 A 4/1998 Brown et al.
5,780,144 A 7/1998 Bradley
5,790,304 A 8/1998 Sanders et al.
5,865,045 A 2/1999 Wagner et al.
5,885,679 A * 3/1999 Yasue et al. ..... 428/57
5,902,070 A * 5/1999 Bradley ..... 405/21
5,921,421 A 7/1999 Fuquan
5,951,345 A 9/1999 Perratone et al.
6,003,565 A 12/1999 Whittier, II et al.
6,047,655 A * 4/2000 Cran ..... 114/74 T
6,056,438 A * 5/2000 Bradley ..... 383/66
6,086,968 A 7/2000 Horovitz
6,101,964 A 8/2000 Lesesne
6,168,191 B1 * 1/2001 Webber et al. ..... 280/730.2
6,186,701 B1 * 2/2001 Kempers ..... 405/19
6,293,217 B1 9/2001 Savage et al.
6,330,865 B1 * 12/2001 Cran ..... 114/74 T
6,497,934 B1 * 12/2002 Mahn et al. ..... 428/57
6,550,410 B2 * 4/2003 Reimers ..... 114/256
6,675,734 B2 * 1/2004 Eagles et al. ..... 114/256
2003/0081862 A1 * 5/2003 Eagles ..... 383/107

FOREIGN PATENT DOCUMENTS

DE 198 21 465 A 11/1999
EP 0 134 706 A 3/1985
EP 0 710 736 A1 11/1994
EP 0 687 625 12/1995
EP 0 862 870 A 9/1998
EP 0 832 032 B1 4/1999
FR 1210934 A * 10/1959 ..... 114/74 T
FR 1269808 A * 8/1961
FR 2 325 837 4/1977
FR 2325837 A * 5/1977
FR 2595621 9/1987
GB 824 984 A 12/1959
GB 826 301 A 12/1959
GB 826301 A * 12/1959 ..... 114/74 T
GB 891121 A * 3/1962 ..... 114/74 T
GB 933 889 A 8/1963
GB 1 079 766 8/1967
GB 1117552 6/1968
GB 1117553 6/1968
GB 1371743 A * 10/1974
JP 60 219243 A 11/1985
WO WO 97/14622 A 4/1997
WO WO 97/49541 12/1997

WO WO 98/01359 A 1/1998

OTHER PUBLICATIONS

"3-D Braided Composites—Design and Applications" by D. Brookstein, 6th European Conference on Composite Materials, Sep. 1993, pp. 225-230.

Pages from web site of Bradley Textiles, Inc.

International Search Report issued by European Patent Office on Jul. 9, 2002 for PCT/US02/10694 filed Apr. 5, 2002.

International Search Report issued by European Patent Office for corresponding international application PCT/US02/10586 mailed Sep. 26, 2002.

International Search Report issued by the European Patent Office on Feb. 6, 2003 for PCT/US02/34299.

International Search Report issued by the European Patent Office on Feb. 10, 2003 for PCT/US02/34052.

* cited by examiner

FLEXIBLE FLUID CONTAINMENT VESSEL FEATURING A KEEL-LIKE SEAM

FIELD OF THE INVENTION

The present invention relates to a flexible fluid containment vessel (sometimes hereinafter referred to as "FFCV") for transporting and containing a large volume of fluid, particularly fluid having a density less than that of salt water, more particularly, fresh water, and the method of making the same.

BACKGROUND OF THE INVENTION

The use of flexible containers for the containment and transportation of cargo, particularly fluids or fluidizable solids, is well known. It is well known to use containers to transport such liquid cargo in water, particularly, salt water. Furthermore, it is common to transport materials which have a density less than that of salt water. If the density of the liquid cargo is less than the density of the liquid cargo, the cargo provides buoyancy for the flexible transport bag when a partially or completely filled bag is placed and towed in salt water. This buoyancy of the cargo provides flotation for the container and facilitates the shipment of the cargo from one seaport to another.

If the cargo is fluid or a fluidized solid that has a density less than salt water; there is no need to use rigid bulk barges, tankers or containment vessels. Rather, flexible containment vessels may be used and towed or pushed from one location to another. Such flexible vessels have obvious advantages over rigid vessels. Moreover, flexible vessels, if constructed appropriately, allow themselves to be rolled up or folded after the cargo has been removed and stored for a return trip.

Throughout the world there are many areas which are in critical need of fresh water. Fresh water is such a commodity that harvesting of the ice cap and icebergs is rapidly emerging as a large business. However, wherever the fresh water is obtained, economical transportation thereof to the intended destination is a concern.

For example, currently an icecap harvester intends to use tankers having 150,000 ton capacity to transport fresh water. Obviously, this involves, not only the cost in using such a transport vehicle, but the added expense of its return trip, unloaded, to pick up fresh cargo. Flexible container vessels, when emptied can be collapsed and stored on, for example, the tugboat that pulled it to the unloading point, reducing the expense in this regard.

Even with such an advantage, economy dictates that the volume being transported in the flexible container vessel be sufficient to overcome the expense of transportation. Accordingly, larger and larger flexible containers are being developed. However, technical problems with regard to such containers persist even though developments over the years have occurred.

SUMMARY OF THE INVENTION

It has been recognized that one of the problems with current FFCVs is the lack of stability they exhibit when being towed in water. That is, FFCVs under tow tend to exhibit sinusoidal movements and/or yaw which interfere with their smooth transport and give rise to undue wear and tear.

Accordingly, it is an object of the present invention to provide an efficient system and method for stabilizing an FFCV under tow in water.

It is a further object of the invention to provide a fabric construction for an FFCV which may be readily varied to meet possible changing requirements for the FFCV.

Still another object of the invention to provide a fabric construction for an FFCV in which seams in the construction may be readily inspected.

In view of the above, an FFCV according to the invention includes at least one segment made up of a fabric. Two ends of the fabric are beaded and are joined together so as to form a generally cylindrical section. The interface, along which the ends of the fabric are joined, forms a keel that serves to stabilize the completed FFCV when the FFCV is placed in water.

BRIEF DESCRIPTION OF THE DRAWINGS

Thus by the present invention, its objects and advantages will be realized the description of which should be taken in conjunction with the drawings wherein.

DETAILED DESCRIPTION OF THE PREFERRED EMBODIMENT

Figure 1:
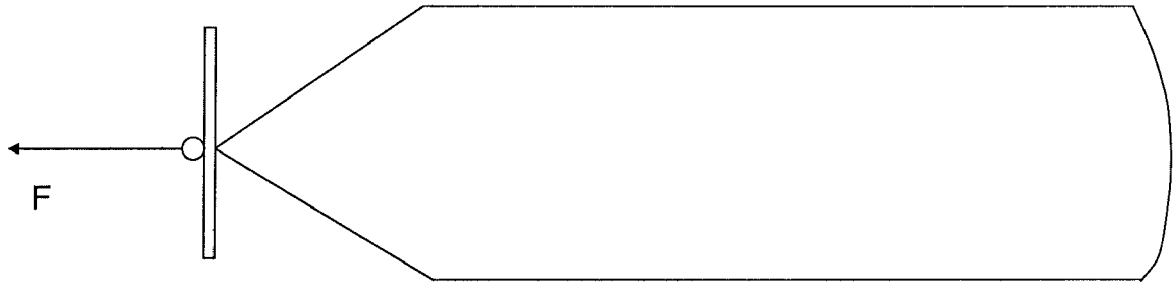
(Prior Art) FIG. 1
FIG. 1 is a somewhat general perspective view of a prior art FFCV which is cylindrical having a pointed bow or nose.
Figure 2:
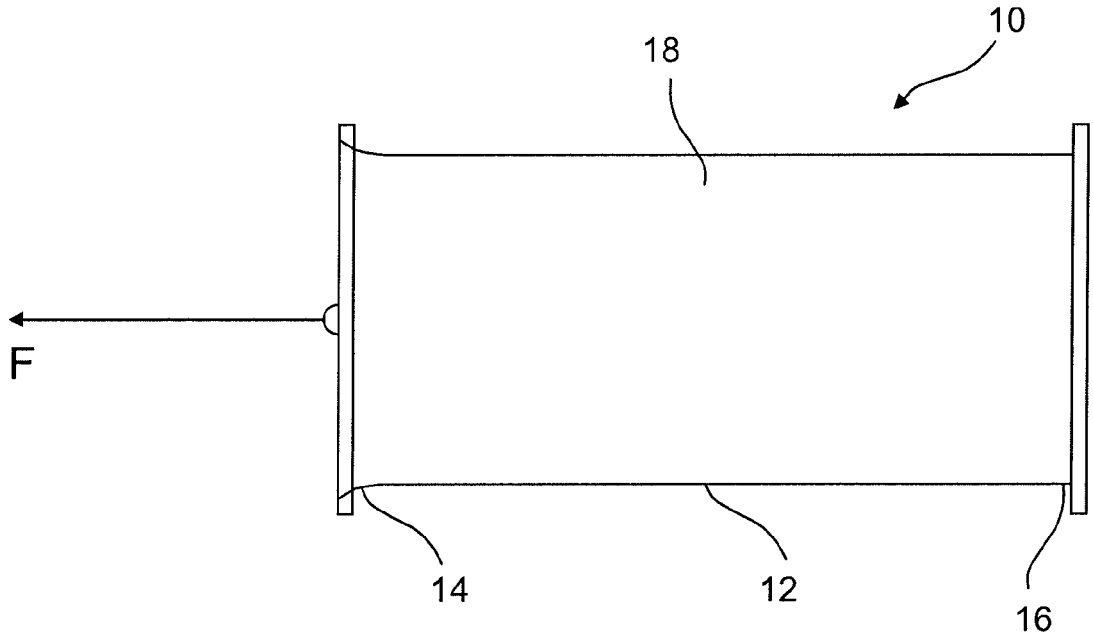
FIG. 2 is a somewhat general perspective view of an FFCV which is formed in segments, incorporating the teachings of the present invention.

The proposed FFCV 10 is intended to be constructed of an impermeable textile tube. The tube's configuration may vary. For example, as shown in FIG. 2, it would comprise a tube 12 having a substantially uniform diameter (perimeter) and sealed on each end 14 and 16. The respective ends 14 and 16 may be closed, pinched, and sealed in any number of ways. A means for loading and unloading cargo (e.g. fresh water) would be provided. The resulting impermeable structure which is fabricated out of segments or strips of material 18 will be flexible enough to be folded or wound up for transportation and storage.

The ends may be sealed by many different ways. For example, the sealed end can be formed by collapsing the end of the tube 12 and folded over one or more times. One end 14 of the tube 12 can be sealed such that the plane of the sealed surface is, either in the same plane as the seal surface at the other end 16 of the tube. End 14 can also be orthogonal to the plane formed by the seal surface at the other end 16 of the tube, creating a bow which is perpendicular to the surface of the water, similar to that of a ship. For sealing, the ends 14 and 16 of the tube may be collapsed such that a sealing length of a few feet results. Sealing may be facilitated by gluing or sealing the inner surfaces of the flattened tube end with a reactive material or adhesive. In addition, the flattened ends 14 and 16 of the tube can be clamped and reinforced with metal or composite bars that are bolted or secured through the composite structure.

Alternatively, the end 14 of the tube 12 may be collapsed and folded such that the width of the sealed end matches either the diameter of the tube or the width of the tube when the tube is filled with water and floated in sea water. This feature of matching the width of the sealed end with either the width of the tube or diameter of the tube as filled will minimize stress concentration when the FFCV is being towed. The end 14 (collapsed and folded) may be sealed with a reactive polymer sealant or adhesive. The sealed end may also be reinforced as previously discussed with metal or composite bars to secure the sealed end and can be provided with a means for attaching a towing device.

In designing the FFCV to withstand the loads placed thereon, certain factors should be considered. In this regard, in U.S. patent application Ser. No. 09/832,739 filed Apr. 11, 2001, now U.S. Pat. No. 6,860,218, entitled "Flexible Fluid Containment Vessel" and incorporated herein by reference, such factors are set forth in detail, along with possible materials for the fabric, their construction and possible coatings and methodology to apply to it to render the fabric impermeable, in addition to other features which may be desirable with regard to the FFCV. Accordingly, further discussion thereof will not be repeated herein rather reference is made to said application.

Also, the present device may have application with regard to the spiral formed FFCV as disclosed in U.S. patent application Ser. No. 09/908,877 filed Jul. 18, 2001, now U.S. Pat. No. 6,675,734, entitled "Spiral Formed Flexible Fluid Containment Vessel" and incorporated herein by reference. While there is discussed therein means and methods for joining the wound strips together to form an FFCV, an alternative thereto is disclosed in the aforesaid first mentioned patent application for all or part of the joining process. For example, in high load portions of the FFCV, typically the front and rear, one methodology may be used. For less stressful locations another methodology may be used.

In addition, reference is made to U.S. patent application Ser. No. 09/921,617 filed Aug. 3, 2001, now U.S. Pat. No. 6,739,274, entitled "End Portions for a Flexible Fluid Containment Vessel and a Method of Making the Same" which relates to possible construction of the end portions of the FFCV and U.S. patent application Ser. No. 09/923,936 filed Aug. 7, 2001, now U.S. Pat. No. 7,308,862, entitled "Coating for a Flexible Fluid Containment Vessel and a Method of Making the Same" which discloses additional construction for the fabric, in addition to possible coatings therefor. Both Ser. Nos. 09/921,617 and 09/923,936 are, incorporated herein by reference.

The fabric 18 can be that of a patchwork to create the FFCV, wound strip or of other configuration suitable for the purpose. For example, it may be made in segments of flat fabric that has one of its dimensions equal to that of the circumference of the FFCV which is formed into a tube and joined with other so formed segments. The variations are endless.

Figure 3:
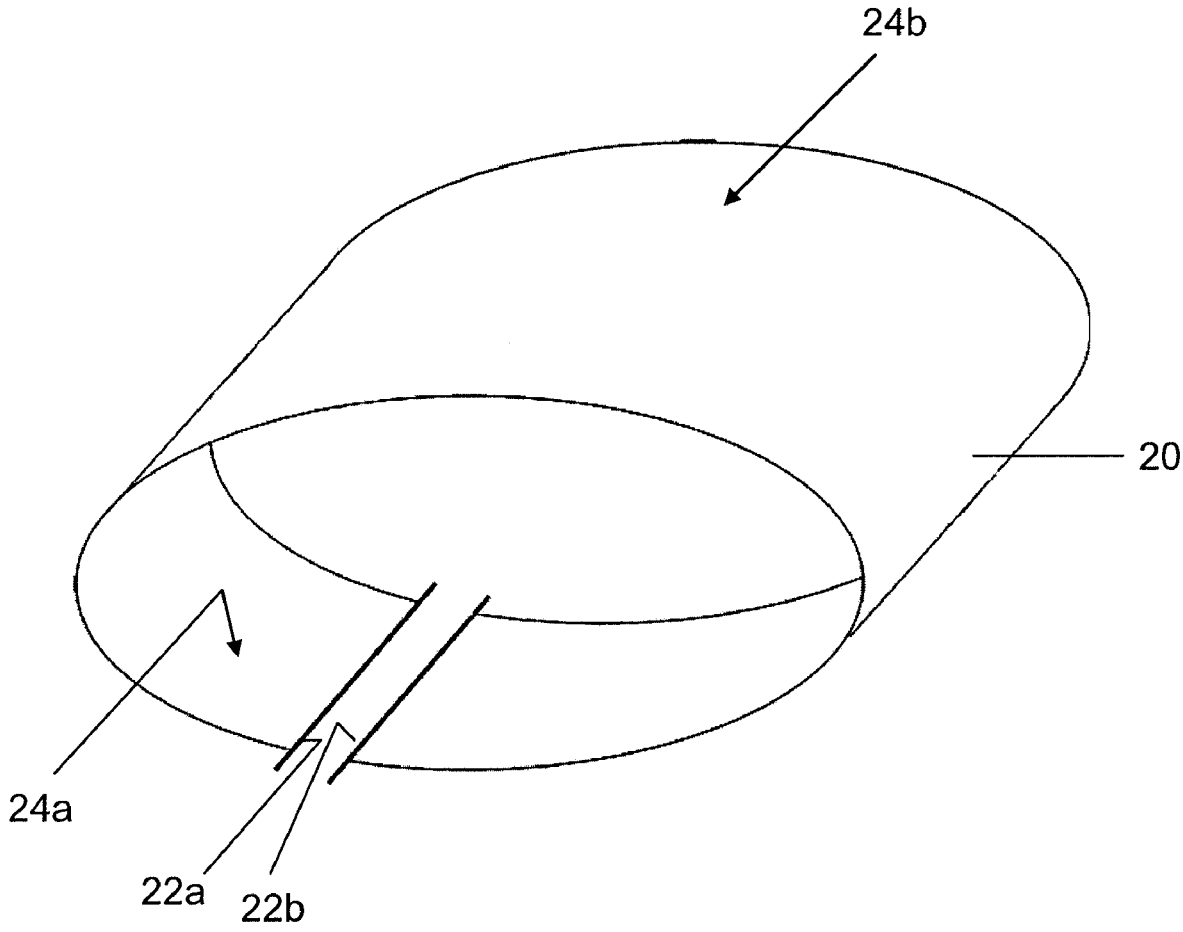
FIG. 3 is a perspective view useful in describing the formation of an FFCV section incorporating the teachings of the present invention.

Turning now to FIG. 3, there is shown a perspective view of an FFCV section formed according to the invention. As can be seen from the figure, a rectangular piece of flat woven fabric 20 is provided. Two opposing ends of the fabric, 22*a* and 22*b*, are beaded such that they can be joined through stitching, sintering, cauterizing, gluing, bonding, overlapping, stapling and/or any other suitable joining method. Upon joining of ends 22*a* and 22*b*, the FFCV section takes on a generally cylindrical shape.

The preferred method of joining the two ends involves using a "circus-tent" type of stitching, that is a hemming stitch, half-cross stitch, or the like. The ends are brought together by the stitching and then the stitching is covered using a two-part reactive resin system. The covering can be, but is not limited to a sheath laminated by adhesive, or a curable liquid coating applied via spraying. The preferable covering material for the seam is two-part polyurethane. Furthermore, the covering is preferably performed on the inner surface 24*a* of the generally cylindrical section rather than on the outer surface 24*b*, creating a water tight seal while leaving the stitching visible and accessible from outside the FFCV. By constructing the section with the stitching visible and accessible from the outside, inspection and maintenance of the seam are facilitated.

Figure 4:
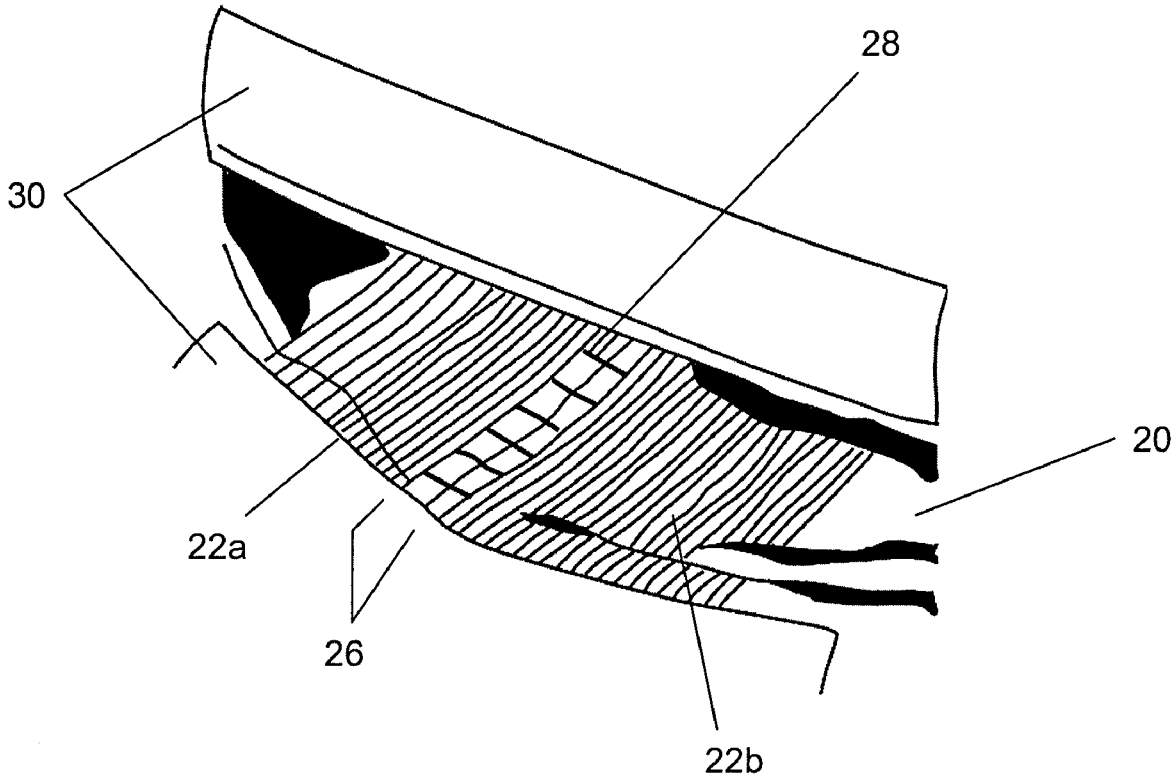
FIG. 4 shows a seam construction in accordance with the present invention.

FIG. 4 shows a seam 26 formed through circus-tent stitching 28. A two-part covering 30 is included in the figure but is pealed back to reveal the stitching underneath. As can be seen, the two ends 22*a* and 22*b* of the flat woven fabric 20 are beaded and include holes for the stitching. As mentioned above, it is preferable that the stitching is visible from outside the FFCV section.

Figure 5:
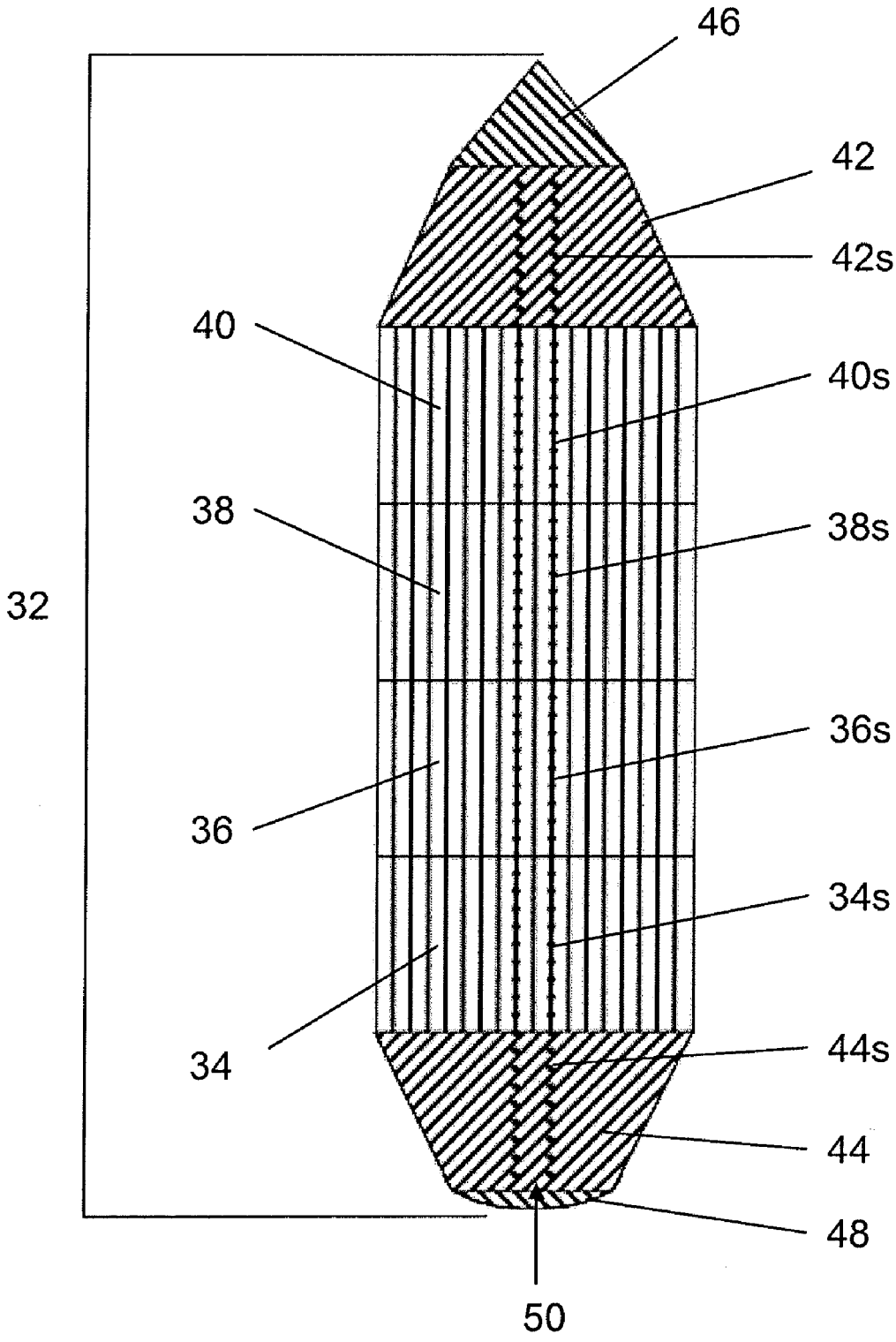
FIG. 5 is a schematic diagram showing an illustrative FFCV construction in accordance with the present invention.
Figure 6:
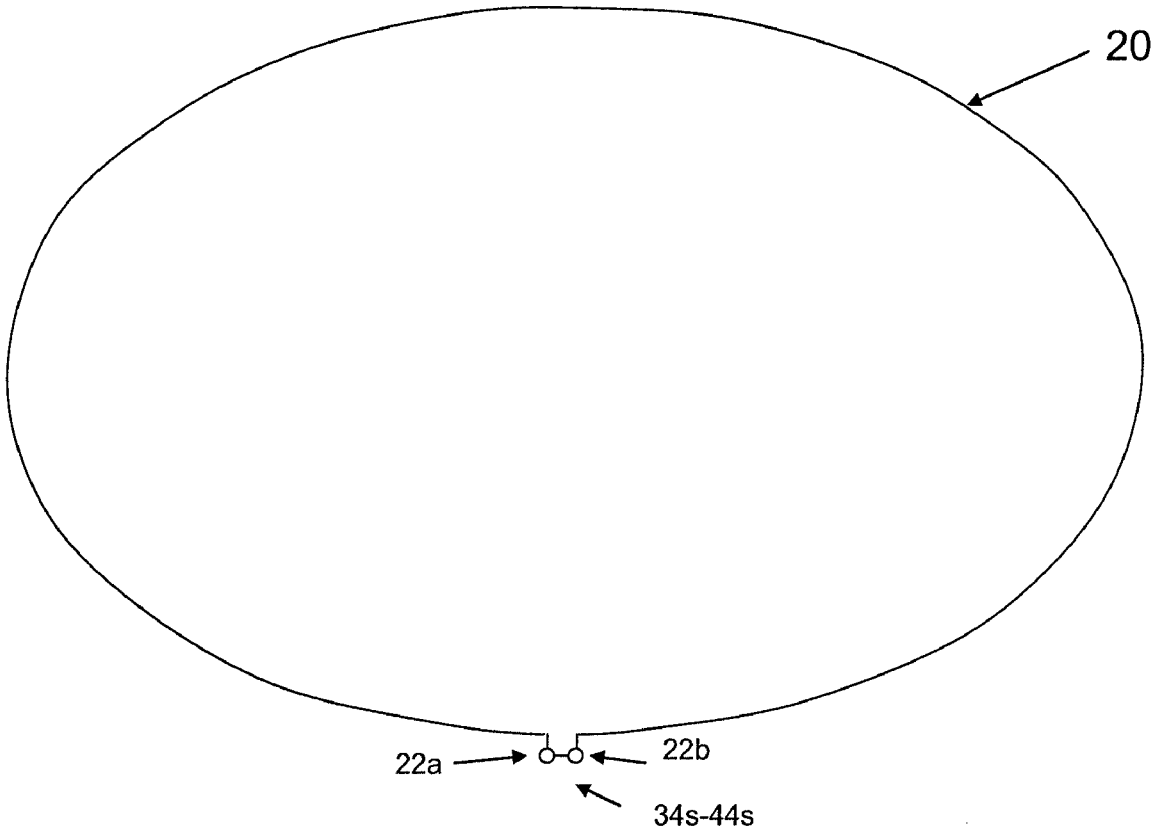
FIG. 6 is a cross-sectional view of a waterborne flexible fluid containment vessel in accordance with the present invention.

Referring to FIG. 5, there is shown an FFCV 32 constructed in part from segments like that shown in FIG. 3. More specifically, the FFCV shown in FIG. 5 includes four such segments 34, 36, 38 and 40. These segments are joined so as to form and overall generally cylindrical body for the FFCV. One way of joining the segments is to use the same stitching and covering technique used to form the individual segments, as described in connection with FIG. 3. Although, it should be noted that many alternative techniques for joining the segments will apparent to the skilled designer when viewed in light of this disclosure.

In addition, the FFCV includes a bow segment 42, a stern segment 44, a bow cap 46 and a stern cap 48. The stern segment and bow segment are each formed in a manner similar to the segment of FIG. 3, one possible exception being that the stern and bow segments are not formed from rectangular pieces of flat woven fabric, but rather, are formed from curved pieces of the fabric. When formed from curved pieces of fabric, the stern and bow segments take on a generally non-cylindrical shape. The bow and stern segments, as well as the caps, may be joined to the overall body in the same manner that the body segments are joined to each other. The non-cylindrical segment and the cap may be employed for sealing the open ends of the cylindrical segment to form a closed fluid containment vessel.

In any event, each of the segments 34-44 include keel-like seams, respectively denoted as 34*s*-44*s*. The seams are aligned so that they form a single keel 50 that is continuous and one piece with the segments and that runs along the greater portion of the FFCV. The keel generally faces downward when the FFCV is placed in a body of water such that the keel is below the surface of the water. In this manner the keel provides stability when the FFCV is under tow, suppressing unwanted snaking and/or yaw.

It should be noted that, if the FFCV is not buoyant, it may be desirable to provide a foamed coating on the inside, outside, or both surfaces of the fabric or otherwise coat it in a manner set forth in the aforesaid applications to render the fabric buoyant.

In view of the closed nature of the FFCV, if it is intended to transport fresh water, as part of the covering/coating process of the inside thereof, it may provide for a coating which includes a germicide or a fungicide so as to prevent the occurrence of bacteria or mold or other contaminants.

In addition, since sunlight also has a degradation effect on fabric, the FFCV may include as part of its coating, or the fiber used to make up the fabric, a UV protecting ingredient in this regard.

While the present invention has been particularly shown and described in conjunction with preferred embodiments thereof, it will be readily appreciated by those of ordinary skill in the art that various changes may be made without departing from the spirit and scope of the invention. Therefore, it is intended that the appended claims be interpreted as including the embodiments described herein as well as all equivalents thereto.

What is claimed is:

1. A waterborne flexible fluid containment vessel for the transportation of cargo comprising a fluid or fluidizable material, said vessel comprising:

a plurality of segments, each segment being formed by joining two ends of a piece of fabric so that the segment takes on a generally cylindrical shape with open ends and a seam at the interface where the two ends of the fabric are joined, said seam forming a keel, wherein said keel is continuous and one piece with said segment, said segments being joined so as to form an overall generally cylindrical body; and means for sealing open ends of bow and stern segments of said overall generally cylindrical body to define a continuous space therebetween and form a closed flexible fluid containment vessel.

2. A vessel in accordance with claim 1 wherein joining said two ends of the fabric includes stitching said ends together.

3. A vessel in accordance with claim 2 wherein said stitching is selected from the group consisting of hemming stitch and half-cross stitching.

4. A vessel in accordance with claim 1 further comprising a covering for said seam to make said seam impervious to fluids.

5. A vessel in accordance with claim 4 wherein said covering is formed of a material comprised of a two-part polyurethane.

6. A vessel in accordance with claim 4 wherein each said segment has an inside and an outside and said covering is applied on the inside of said segment such that said seam remains visible from outside said vessel.

7. A vessel in accordance with claim 1 wherein said seams of said segments are aligned to form said keel along said overall generally cylindrical body.

8. A vessel in accordance with claim 1 wherein said means for sealing the open ends of said overall generally cylindrical body includes a generally non-cylindrical segment and a cap.

9. A vessel in accordance with claim 1 wherein said means for sealing the open ends of said generally cylindrical body includes a generally non-cylindrical segment and a cap.

10. A vessel in accordance with claim 1 wherein said piece of fabric is a piece of flat woven fabric that is impervious to fluids.

11. A method of forming a waterborne flexible fluid containment vessel for the transportation of cargo comprising a fluid or fluidizable material, comprising the steps of:

forming a plurality of segments, each segment being formed by joining two ends of a piece of fabric so that the segment takes on a generally cylindrical shape with open ends and a seam at the interface where the two ends of the fabric are joined, said seam forming a keel, wherein said keel is continuous and one piece with said segment;

joining said segments to form an overall generally cylindrical body; and sealing open ends of bow and stern segments of said overall generally cylindrical body to define a continuous space therebetween and form a closed flexible fluid containment vessel.

12. A method of forming a vessel in accordance with claim 11 wherein the step of joining two ends of the fabric includes stitching said two ends together.

13. A method of forming a vessel in accordance with claim 12 wherein said step of stitching includes stitching in a fashion selected from the group consisting of hemming stitch and half-cross stitch.

14. A method of forming a vessel in accordance with claim 11 further comprising the step of covering said seam to make said seam impervious to fluids.

15. A method of forming a vessel in accordance with claim 14 wherein said step of covering includes providing a covering formed of a material comprised of a two-part polyurethane.

16. A method of forming a vessel in accordance with claim 14 wherein each said segment has an inside and an outside and said step of covering is involves covering said seam on the inside of said segment such that said seam remains visible from outside said vessel.

17. A method of forming a vessel in accordance with claim 11 further comprising the step of aligning said seams of said segments to form said keel along said overall generally cylindrical body.

18. A method of forming a vessel in accordance with claim 11 wherein said step of sealing the open ends of said overall generally cylindrical body includes using a generally non-cylindrical segment and a cap.

19. A method for forming a vessel in accordance with claim 11 wherein said step of sealing the open ends of said generally cylindrical body includes using a generally non-cylindrical segment and a cap.

20. A method for forming a vessel in accordance with claim 11 wherein said piece of fabric is a piece of flat woven fabric that is impervious to fluids.

* * * * *